US006856303B2

(12) United States Patent
Kowalewski

(10) Patent No.: US 6,856,303 B2
(45) Date of Patent: Feb. 15, 2005

(54) ROTATING DISPLAY SYSTEM

(76) Inventor: Daniel L. Kowalewski, 412 Palos Verdes Blvd., Redondo Beach, CA (US) 90277

( * ) Notice: Subject to any disclaimer, the term of this patent is extended or adjusted under 35 U.S.C. 154(b) by 458 days.

(21) Appl. No.: 10/004,094

(22) Filed: Oct. 23, 2001

(65) Prior Publication Data

US 2002/0135541 A1 Sep. 26, 2002

Related U.S. Application Data

(60) Provisional application No. 60/242,961, filed on Oct. 24, 2000.

(51) Int. Cl.[7] ..... G09G 3/00

(52) U.S. Cl. ..... 345/31; 345/82; 345/108; 40/430

(58) Field of Search ..... 345/30, 31, 39, 345/46, 82, 108; 340/815.53, 815.4, 815.86, 815.87; 60/430, 431, 473, 493

(56) References Cited

U.S. PATENT DOCUMENTS

| | | | | | |
|---|---|---|---|---|---|
| 3,744,048 | A | | 7/1973 | Treichel | |
| 3,846,784 | A | | 11/1974 | Sinclair | |
| 4,160,973 | A | * | 7/1979 | Berlin, Jr. | 345/31 |
| 4,225,862 | A | | 9/1980 | Johnson | |
| 4,689,604 | A | | 8/1987 | Sokol | |
| 5,057,827 | A | * | 10/1991 | Nobile et al. | 345/31 |
| 5,302,965 | A | | 4/1994 | Belcher et al. | |
| 5,444,456 | A | * | 8/1995 | Ohta et al. | 345/39 |
| 5,670,971 | A | * | 9/1997 | Tokimoto et al. | 345/31 |
| 5,903,224 | A | | 5/1999 | Reynolds | |
| 6,037,876 | A | * | 3/2000 | Crouch | 340/815.53 |
| 6,115,006 | A | * | 9/2000 | Brotz | 345/6 |
| 6,265,984 | B1 | * | 7/2001 | Molinaroli | 340/815.4 |
| 6,278,419 | B1 | * | 8/2001 | Malkin | 345/31 |
| 6,486,858 | B1 | * | 11/2002 | Altman | 345/31 |

OTHER PUBLICATIONS

Bob Blick, "Propeller Clocks Built By Others;" www.bob-blick.com; May 27, 2000; pp. 1–4; Internet Archive, San Francisco, CA, USA; www.archive.org.

Luberth Dijkman, "New Analog & Digital Clock;" home.wxs.nl/~luberth/propklok.htm; Feb. 21, 1999; pp. 1–4; Internet Archive, San Francisco, CA, USA; www.archive.org.

* cited by examiner

*Primary Examiner*—Xiao Wu
(74) *Attorney, Agent, or Firm*—Glenn R. Smith

(57) ABSTRACT

A pixel-based display utilizes persistence-of-vision to sweep text and graphics in a cylindrical plane, including time and date, custom messages and animations. The display is generated from a light array with a column of modulated light emitting elements, which is mounted on a rotating display assembly. Power and data are combined on a fixed control assembly and inductively coupled to the display assembly. A control assembly processor interprets a display application language that describes display-specific tasks to generate command, mode, character and graphic data for the display assembly. The control assembly processor also reads a trigger position sensor and adds a trigger delay to generate a virtual trigger command, which provides for flexible display positioning and scrolling display effects.

11 Claims, 12 Drawing Sheets

ROTATING DISPLAY SYSTEM

CROSS-REFERENCE TO RELATED APPLICATIONS

This application claims the benefit of provisional patent application No. 60/242,961 entitled Electronic Rotating Display, filed Oct. 24, 2000.

REFERENCE TO COMPUTER PROGRAM LISTING APPENDIX

This application incorporates by reference a computer program listing appendix, referred to herein as Appendix C and contained on each of two identical CD-R discs submitted herewith as filename: KOWA.001A Appendix.C; size: 24 KB; created: Oct. 22, 2001.

BACKGROUND OF THE INVENTION

Electronic displays are pervasive in the modem world. Various incarnations of cathode-ray tube, vacuum florescent, light emitting diode (LED), liquid crystal display (LCD) and more recently laser diode and light valve technologies are applied in electronic devices used to visually transfer information. Common displays typically provide visual information arranged as pixels or vectors in a two-dimensional plane. The information transmitted by the device is usually alphanumeric or graphical in nature. The content of the information is only limited by the imagination of the purveyors.

SUMMARY OF THE INVENTION

Advances in microcontroller technology and electronics in general have created the possibility of new and interesting methods of displaying text and graphics. For example, LED displays placed in motion and modulated in a controlled manner can cause stable characters to appear as the result of a phenomenon known as "persistence of vision." Practical and inexpensive persistence-of-vision display products, however, are not currently available. Some devices rely on manually-generated motion, creating a non-uniform display and requiring battery power. On these devices, messages must be input manually and cannot be controlled or programmed via an external interface. Other devices rely on a pendulum motion to create the display surface. The pendulum constrains the horizontal width of the display by the vertical height of the display member. In other words, in order to maintain a reasonably substantial, linear, horizontal display area, the height of the device must be proportionally greater. This forces the overall size of the product to be at least 3 or 4 times higher than it is wide. The current designs also lack any kind of remote operation or programming capability.

One aspect of the present invention is a display system comprising a base and an electric motor supported by the base. A shaft extends from the motor and is operable so as to rotate when power is applied to the motor. An elongated, generally planar display assembly is center mounted to the shaft so that the display assembly rotates as the shaft rotates. A light array is mounted to an end portion of the display assembly so as to sweep out a generally cylindrical path as the display assembly rotates. An elongated, generally planar control assembly is fixedly mounted to the base between the motor and the display assembly. The control assembly is configured to accommodate the shaft, and an inductive coupling is adapted to provide electrical communications between the control assembly and the display assembly.

In one embodiment, the display system further comprises a first switch located on the control assembly configured to transfer power from a power source to the inductive coupling and a power block located on the display assembly configured to transfer power from the inductive coupling to the display assembly. The display system may further comprise a first processor located on the control assembly and operable to generate a plurality of display commands and a second switch located on the control assembly and in electrical communications with the first processor, where the second switch is configured to transfer the display commands to the inductive coupling. Also, a second processor may be located on the display assembly, and a data block may be located on the display assembly configured to transfer the display commands from the inductive coupling to the second processor. The second processor may be operable to transfer display data to the light array according to the display commands.

In a particular embodiment, the display system may further comprise a sensor output responsive to a position of the display assembly relative to the control assembly, the first processor in communications with the sensor output so as to generate a trigger command to the second processor, the trigger command incorporating a variable trigger delay, the trigger command indicating the apparent position of a pixel display. The display system may also further comprise a push button switch operable in conjunction with a menu presented on the pixel display so as to set an operational mode. In addition, the display system may further comprise a plurality of display language instructions for display specific tasks, the display language instructions interpreted by the first processor so as to generate the display commands. The inductive coupling may comprise a first inductive coupler mounted on the display assembly concentric with the shaft and a second inductive coupler mounted on the control assembly concentric with the shaft, the first inductive coupler and the second inductive coupler maintained at a fixed distance apart. The sensor may comprise a Hall-effect sensor mounted on the control assembly and a magnet mounted on a base portion of the shaft so that the magnet repeatedly passes under the Hall-effect sensor as the shaft rotates.

Another aspect of the rotating display system according to the present invention provides an inexpensive way of synthesizing a warped two-dimensional, e.g. cylindrical, plane of display elements used for visually transmitting information. In one embodiment, the display sweeps text, such as time, date, day of the week, custom messages, graphics and animations in a cylindrical plane using a vertical light array comprised of a column of modulated light emitters. A display assembly may be spun by any electromechanical or electromagnetic means. For example, the display assembly may be mounted to a shaft of a brushless DC motor. As the rotation of the light array increases, the visibility of the light array decreases. Thus when the rotating display system is operating, it appears as though the information displayed is suspended in air, following a contour of an invisible cylindrical plane. This effect draws attention to the display and, thus, to the messages or images it transmits. In one embodiment, power and data are both provided to the rotating display assembly inductively. Hence, there is no physical electrical connection between the stationary and moving assemblies. Thus, there are no slip rings or brushes that would reduce the life of the display system.

In one embodiment, the display system may be updated in real time. This implies that the display is not limited to "canned" or pre-programmed static messages. Data can be transferred to the rotating display assembly to generate 2-D scrolling and animation effects as well as to update the text of the display electronically via a separate data source. For example, with an appropriate interface the display system could be used in conjunction with an electronic network to display stock quotes. The display data may scroll 360 degrees on a cylindrical plane. A person may view the display from any vantage surrounding the display. The display data is bit-mapped. Thus any alphanumeric characters as well as custom icons or graphics can be output for static or animated effects.

In another embodiment, the display system has a simple one-button interface. The mode or action of the display can be changed using the button for selection coupled with an appropriate menu algorithm. For example, if the display system is being used as a clock and the user would like to set the clock, the user would initiate a menu mode by pressing the button. Then, when an appropriate menu item such as "Set Clock?" appears, the user would again press the button. This would initiate a mode where the display would cycle through the hours on the clock. When an appropriate hour such as 3:00 PM is displayed, the user again presses the button, thus selecting the hour of the day.

In a further embodiment, various aspects of the display system are microprocessor controlled. This allows flexibility with regards to the operation of the display system, especially considering that the display system includes re-programmable nonvolatile memory. This memory includes program and data space that allow the operation of the display system to be customized and numerous messages and images to be stored and displayed according to the particular program operating the apparatus. The display system may be programmed externally via a computer cable and adapter. This feature allows re-sellers to program the unit with their own appropriate functions and messages to target a particular market segment. Further, end users may program the unit to suit their own particular needs. The display system is also remotely controllable so that messages and images are dynamically changed and displayed. In one embodiment, the display system includes an internal clock and calendar. This gives the display system a self-contained ability to display messages based on holidays, anniversaries or user defined events. It also allows the display system to change mode based on time.

A further aspect of the present invention is a display method comprising the steps of describing a pixel display with a display instruction, interpreting the display instruction so as to create a display command, and generating a data signal responsive to the display command. Further steps comprise deriving a plurality of column data responsive to the data signal, rotating a display assembly about an axis so that a light array mounted on the display assembly sweeps along an arc surface, and modulating the light array with the column data so as to create a viewable area of the pixel display across at least a portion of the arc surface.

In one embodiment, the display method comprises the further steps of combining a power source and the data signal into a waveform, inductively coupling the waveform to the display assembly, filtering display assembly power from the waveform, and decoding the data signal from the waveform. The waveform may be a square wave, where the data signal is a plurality of bits and the combining step comprises the substeps of switching the power source so as to generate the square wave, interrupting the square wave for a first time period in response to each of the bits that is a one, and interrupting the square wave for a second time period in response to each of the bits that is a zero. In a particular embodiment, the square wave has a time period of T and the first time period is about 10T, the second time period is about 20T, and the decoding step comprises the substeps of generating a zero bit if the square wave ceases for a time period greater than 15T and generating a one bit if the square wave ceases for a time period less than 15T.

In another embodiment, the display method comprises the further steps of sensing a trigger position of the display assembly, adding a variable delay to the trigger position so as to create a virtual trigger position, initiating the modulating step in response to the virtual trigger position, and adjusting the variable delay so as to position the viewable area. In a particular embodiment, the display method comprises the further steps of designating a front position for the pixel display, calculating the viewable area from a rotational speed of the display assembly and a number of columns of the pixel display, and determining the variable delay from the viewable area and the trigger position so as to position a center of the viewable area at the front position. Further aspects of the rotating display system will become apparent from a consideration of the drawings and ensuing description.

DETAILED DESCRIPTION OF THE PREFERRED EMBODIMENTS

Figure 4:
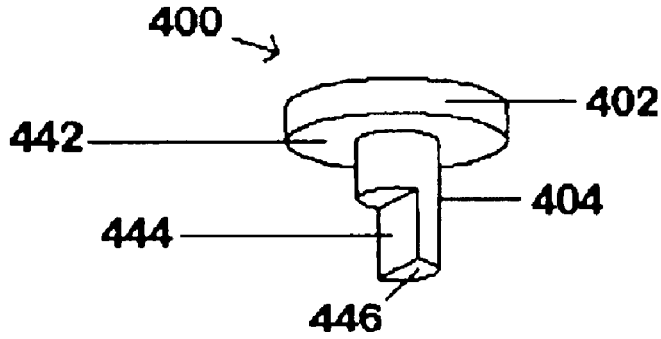
FIG. 4 is a perspective view of a shaft mate.
Figure 5:
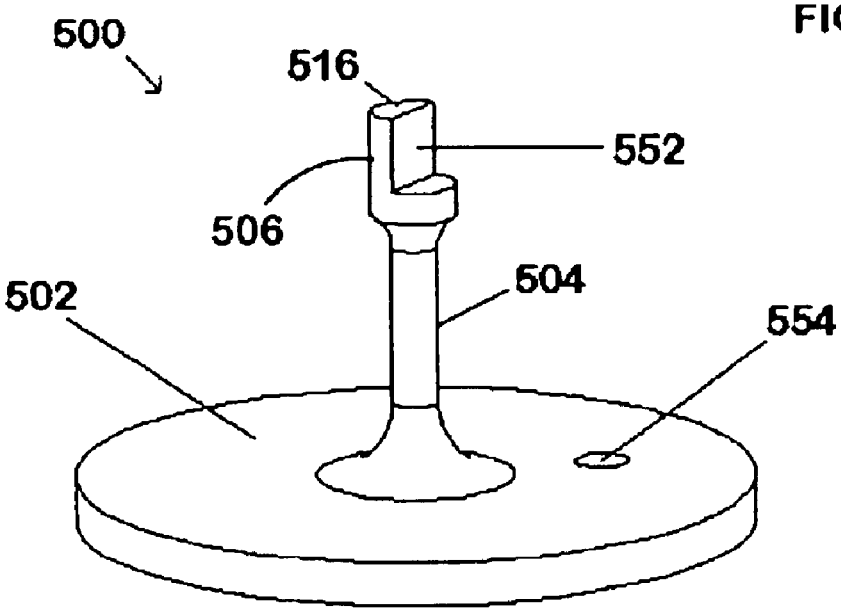
FIG. 5 is a perspective view of a shaft.
Figure 6:
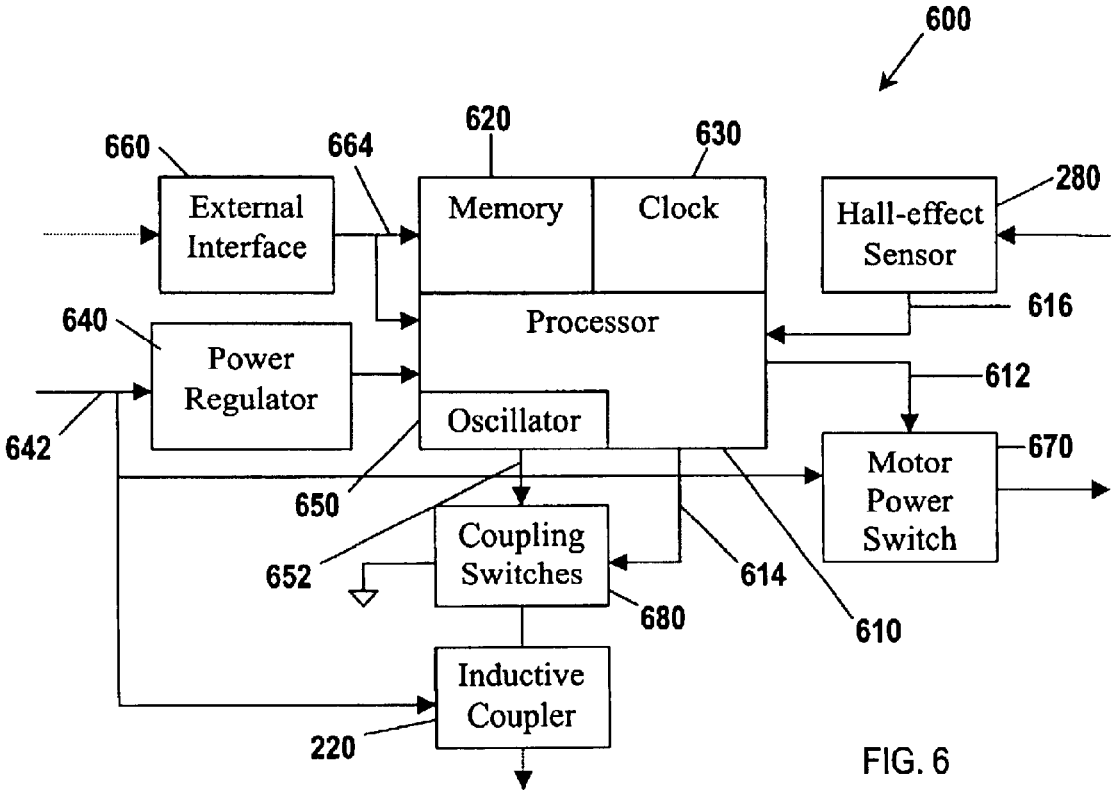
FIG. 6 is a functional block diagram of a control assembly.
Figure 7:
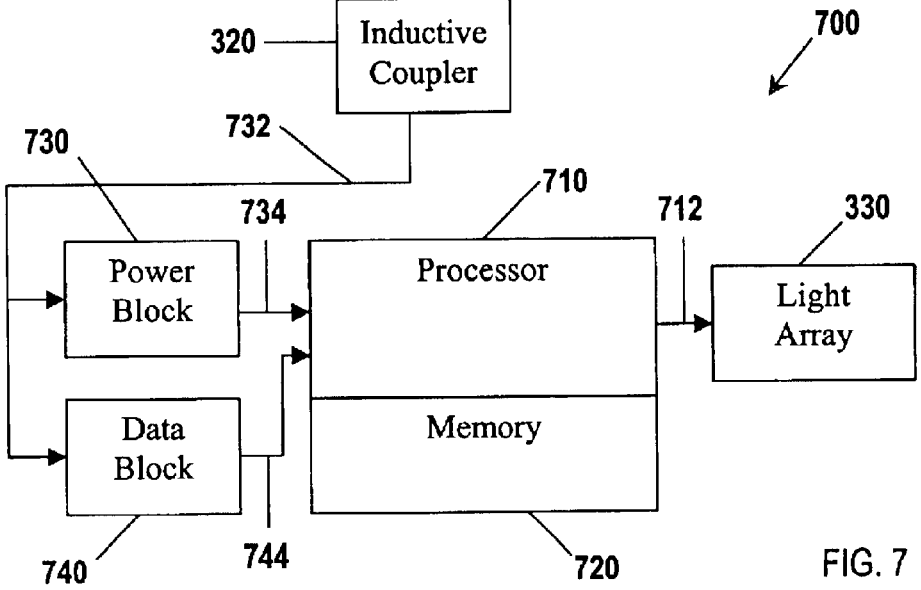
FIG. 7 is a functional block diagram of a display assembly.
Figure 8:
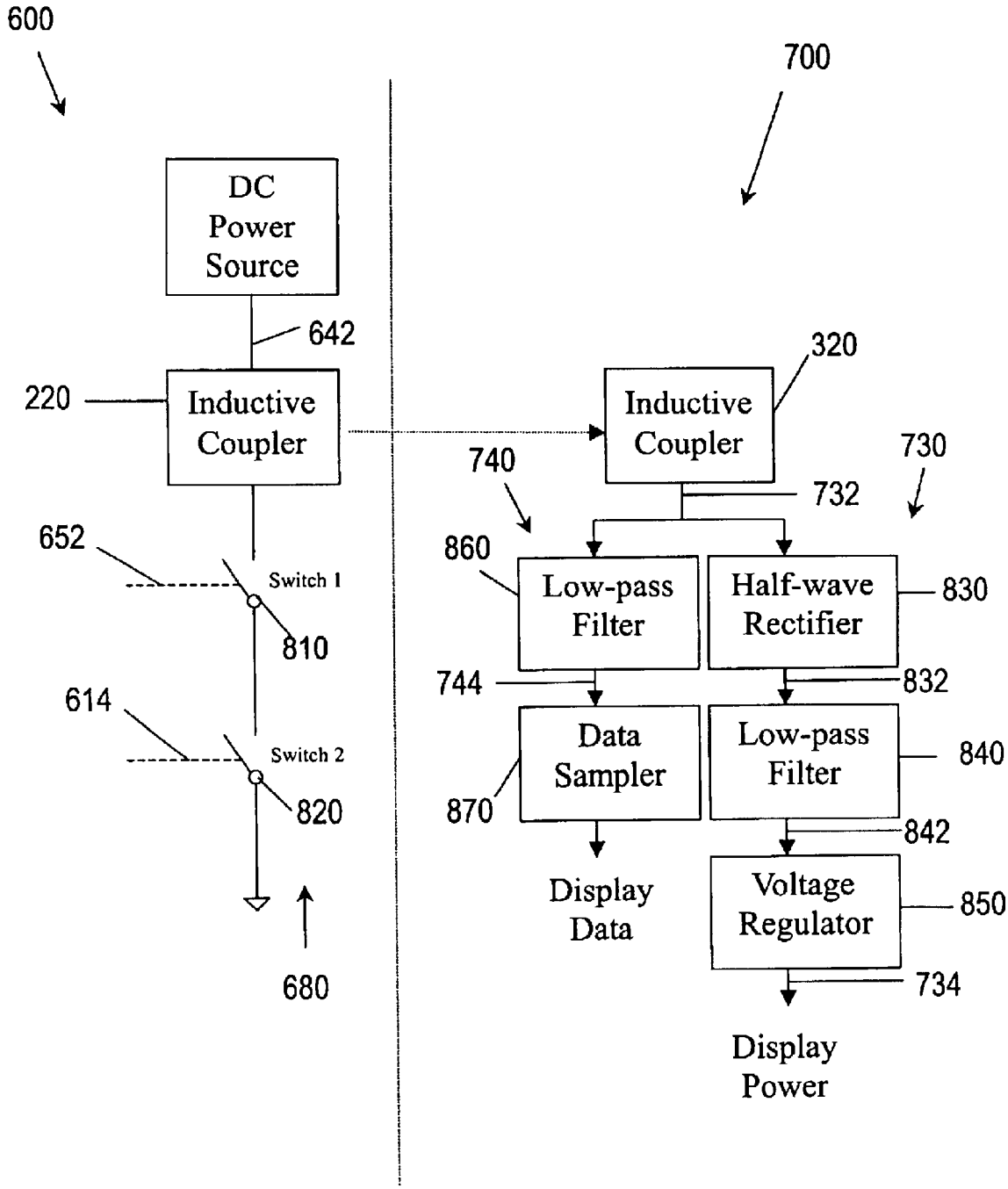
FIG. 8 is a detailed functional block diagram of inductive power transfer and data communications aspects of the control and display assemblies.

FIGS. 1–12 illustrate a rotating display system 100. In particular, FIGS. 1–5 illustrate mechanical hardware aspects of a rotating display system 100. Also, FIGS. 6–8 illustrate electrical hardware aspects of a rotating display system 100. Further, FIGS. 9–12 illustrate software aspects of a rotating display system 100.

Hardware Configuration

Mechanical

Figure 1A:
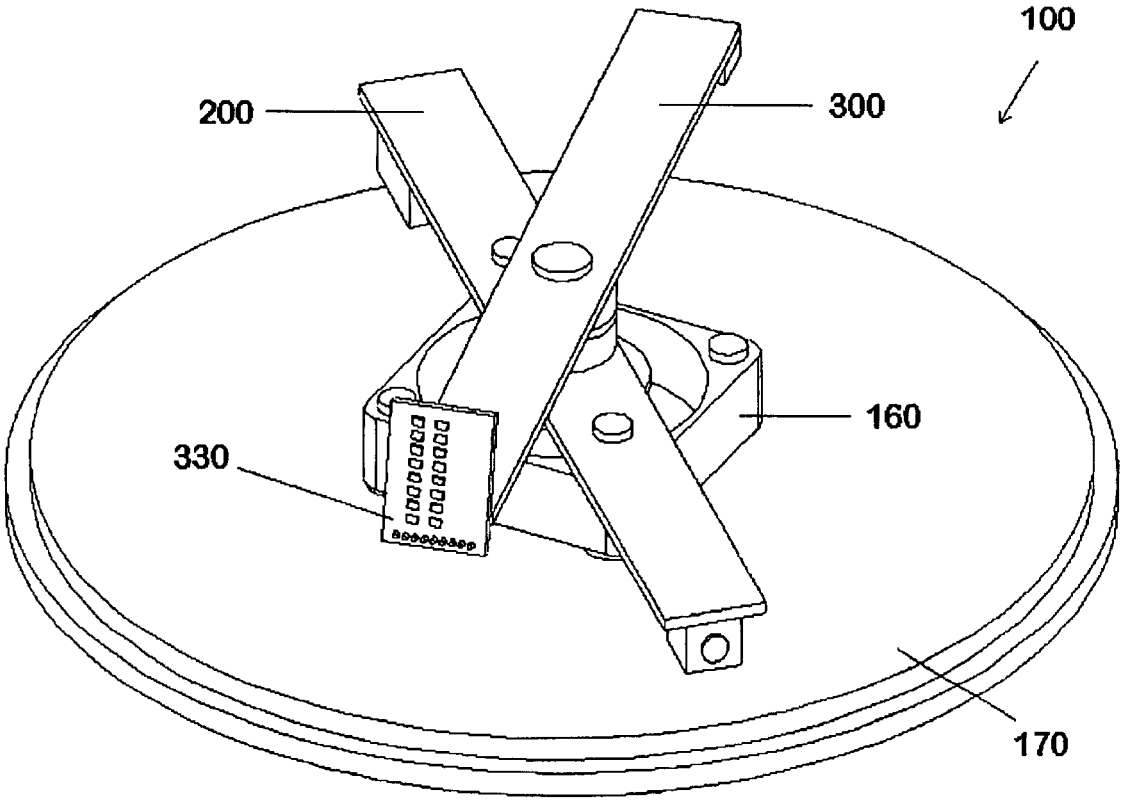
FIGS. 1A–B are perspective and exploded views, respectively, of a rotating display system.
Figure 1B:
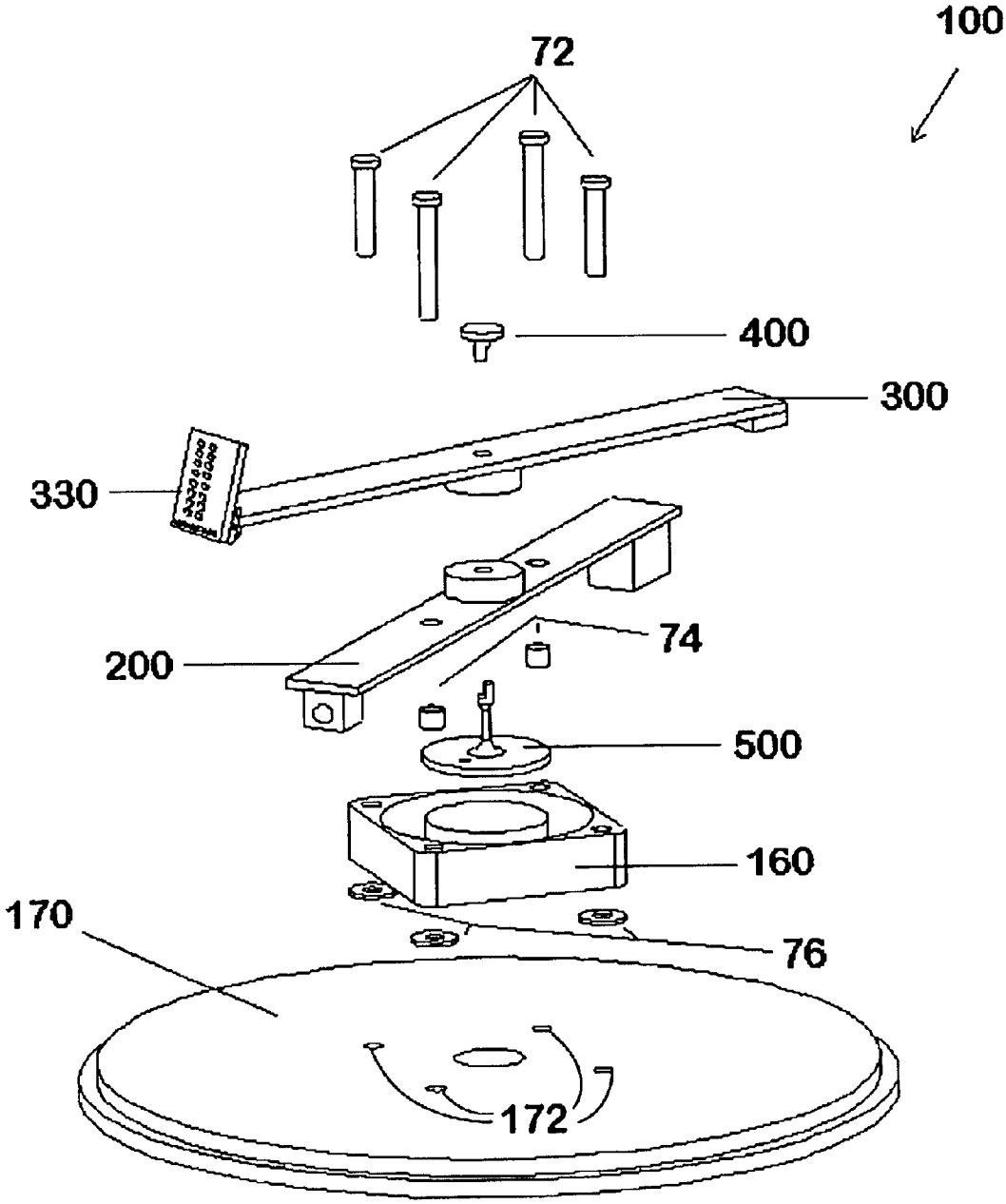

FIGS. 1A–B illustrate a mechanical hardware configuration for a rotating display system 100. As shown in FIG. 1A, the display system 100 has a control assembly 200, a display assembly 300, a light array 330 mounted on the display assembly 300, and a motor 160 mounted on and supported by a base 170. The control assembly 200 has a processor 610 (FIG. 600) that controls display rotation, processes display data and transmits data to the display assembly 300, as described with respect to FIGS. 6, 8 and 11, below. The display assembly 300 has a processor 710 (FIG. 7) that receives display data and formats it for the light array 330, as described with respect to FIGS. 7, 8 and 12, below.

As shown in FIG. 1B, the display system 100 also has a shaft mate 400 and a shaft 500. The shaft 500 is attached to the motor 160 and, in conjunction with the shaft mate 400, supports the display assembly 300, as described with respect to FIGS. 4–5, below. The control assembly 200 and motor 160 are secured to the base 170 using mounting screws 72 inserted through spacers 74 and washers 76 and threaded into base mounting holes 172. The spacers 74 separate the motor 160 and the control assembly 200 by a fixed distance, which is approximately ⅛ inch in one embodiment. The washers 76 are mounted between the motor 160 and the base 170, and, alternatively, may be rubber grommets. In one embodiment, the motor 160 is a brushless DC motor, although the display assembly 300 may be spun by any electromechanical or electromagnetic apparatus.

When power is applied to the display system 100, the control assembly processor 610 (FIG. 6) switches on the motor 160 and the display assembly 300 spins up to operating speed, which is approximately 900 rpm in one embodiment. Once the display assembly 300 has spun up, the control assembly processor 610 (FIG. 6) turns on the display assembly 300 and advantageously sends both power and data, such as commands, display data and trigger information, across an inductive coupling 220 (FIGS. 2A–B), 320 (FIGS. 3A–C) to the display assembly processor 710 (FIG. 7). The display assembly processor 710 (FIG. 7) interprets the information sent by the control assembly processor 610 (FIG. 6) and modulates the light array 330 with column data. The column data is presented on a pixel display such that an observer sees words, characters, icons and/or any other pixel-based shapes contained in a control assembly memory 620 (FIG. 6). In one embodiment, the effective size of the pixel display is 60 pixels wide by 8 pixels high and can move 360 degrees around the axis of the display assembly 300.

The partitioning of the display system electronics between a fixed control assembly 200 and a rotating display assembly 300 advantageously allows user input via a push button switch 240 (FIG. 2A) while the pixel display is operating. Further, because the pixel display is operating, this feature allows user interaction with the pixel display via a menu selection process, as described below. That is, because display system control is implemented on a fixed control assembly 200, it is unnecessary for the user to stop rotation of the display assembly 300 and perform a "blind" input process. Also, providing a fixed control assembly 200 advantageously allows the pixel display to be updated during operation utilizing a standard interface to the outside world, as described below. For example, stock quotes may be loaded into the pixel display in real time via an I2C bus.

Figure 2A:
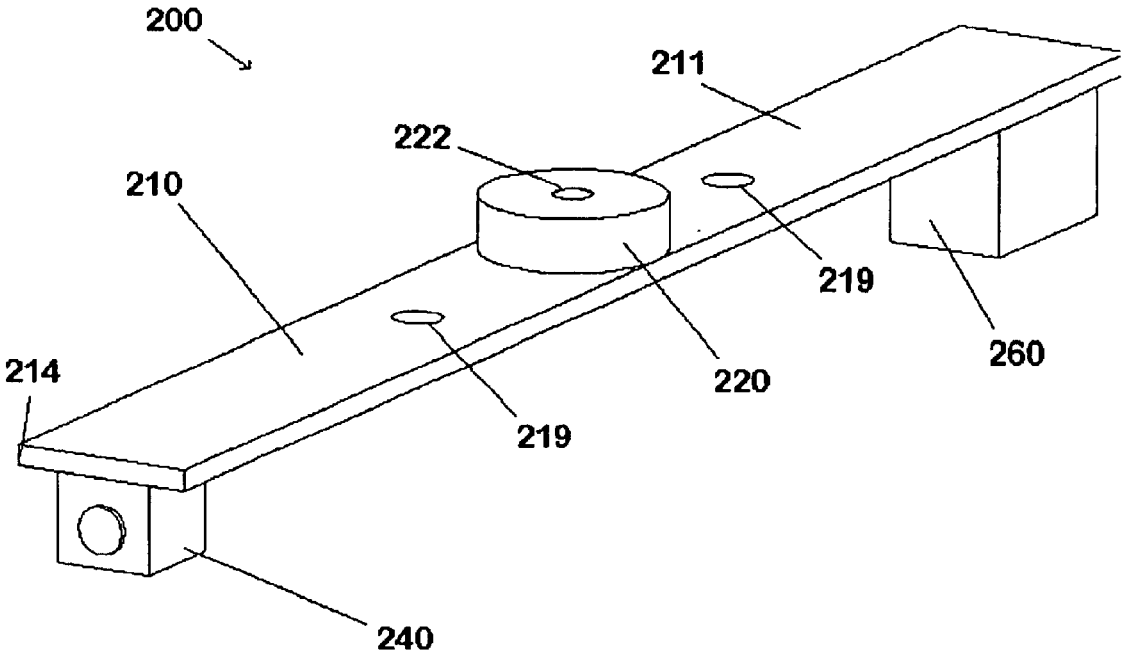
FIGS. 2A–B are top and bottom perspective views, respectively, of a control assembly.
Figure 2B:
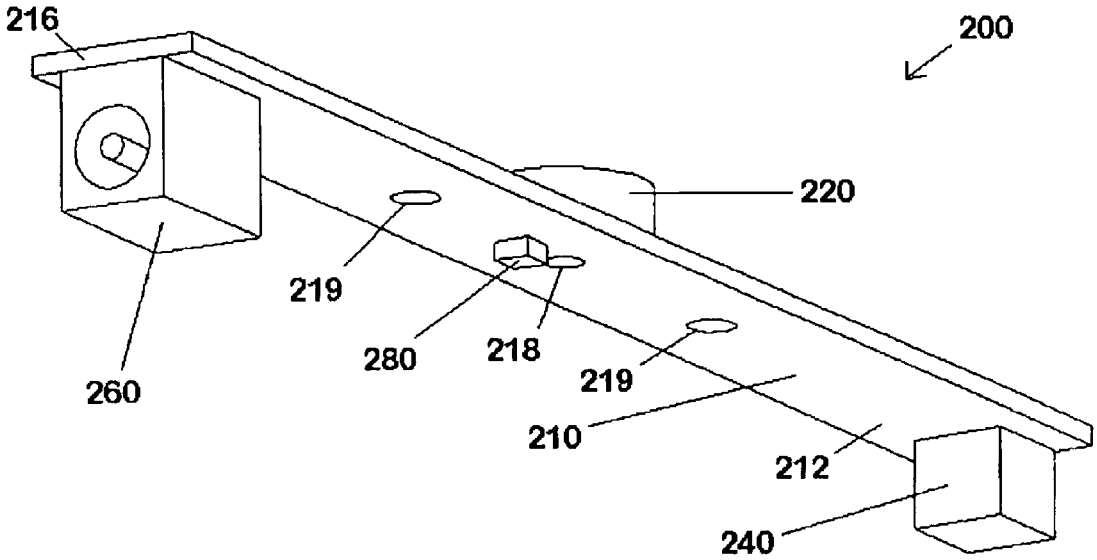

FIGS. 2A–B illustrate one embodiment of the control assembly 200, which has a control assembly printed circuit board (PCB) 210, an inductive coupler 220, a push-button switch 240, a power jack 260, and a Hall-effect sensor 280. The control assembly components are mounted on and interconnected by the PCB 210, which is a substrate carrying conductive traces, as is well-known in the art. The PCB 210 has a generally planar and elongated shape with a first side 211, an opposite second side 212, a first end 214, an opposite second end 216, a center hole 218 and a pair of mounting holes 219 located on either side of the center hole 218.

As shown in FIGS. 2A–B, the inductive coupler 220 has a cylindrical cavity 222 and is mounted on the first side 211 at the center of the PCB 210 such that the cylindrical cavity 222 is aligned with the PCB center hole 218. The control assembly inductive coupler 220 works in conjunction with the display assembly inductive coupler 320 (FIGS. 3A–B) to transmit power, commands, data and trigger information between the control assembly 200 and the display assembly 300, as described with respect to FIGS. 6–8, below.

Also shown in FIGS. 2A–B, the push-button switch 240 is mounted on the second side 212 proximate the first end 214. The push-button switch 240 functions in conjunction with a menu presented on the rotating display system 100 to set the mode or action of the display 100, as described with respect to FIGS. 10–11, below. The power jack 260 is mounted on the second side 212 proximate the second end 216 and is configured to mate with a corresponding external plug are to supply power to the display system 100, as described in detail with respect to FIGS. 6–8, below.

Further, FIG. 2B shows that the Hall-effect sensor 280 is mounted on the second side 212 and positioned on the PCB 210 so that the shaft magnet 554 (FIG. 5) will pass directly under it as the shaft 500 (FIG. 5) spins. In one embodiment, both the shaft magnet 554 (FIG. 5) and the sensor 280 are located approximately ¼ inch off the control assembly 200 center of rotation. The Hall-effect sensor 280 provides a trigger pulse that indicates the rotational position of the display assembly 300 (FIGS. 3A–C) as it spins, allowing the synchronization of display information, as described with respect to FIG. 11, below.

Figure 3A:
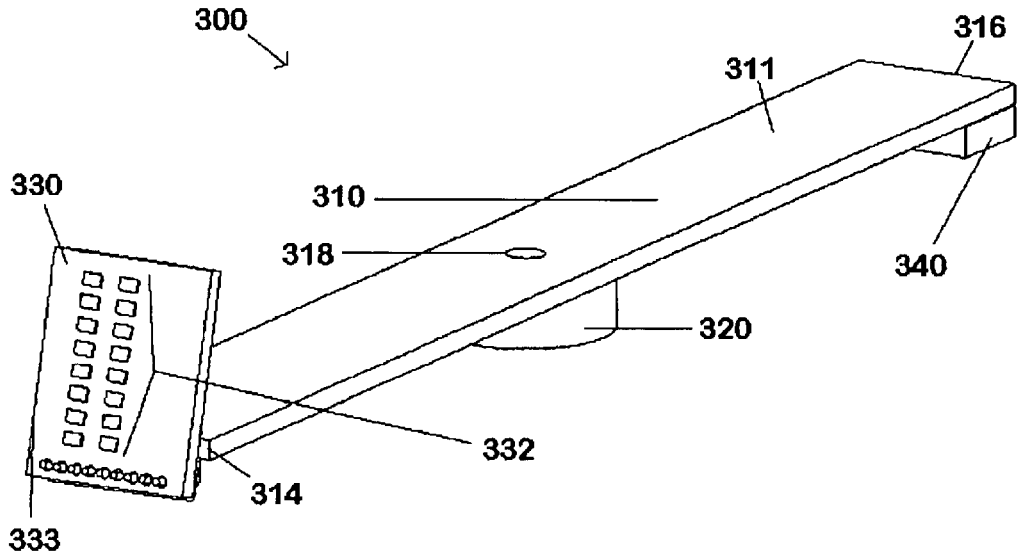
FIGS. 3A–C are top perspective, bottom perspective, and exploded views, respectively, of a display assembly.
Figure 3B:
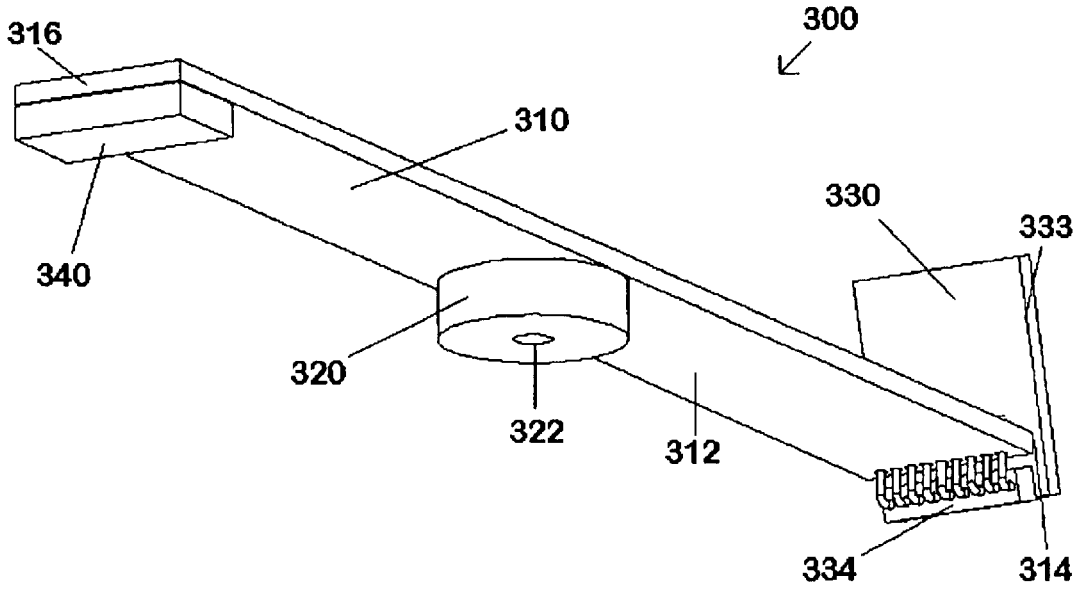
Figure 3C:
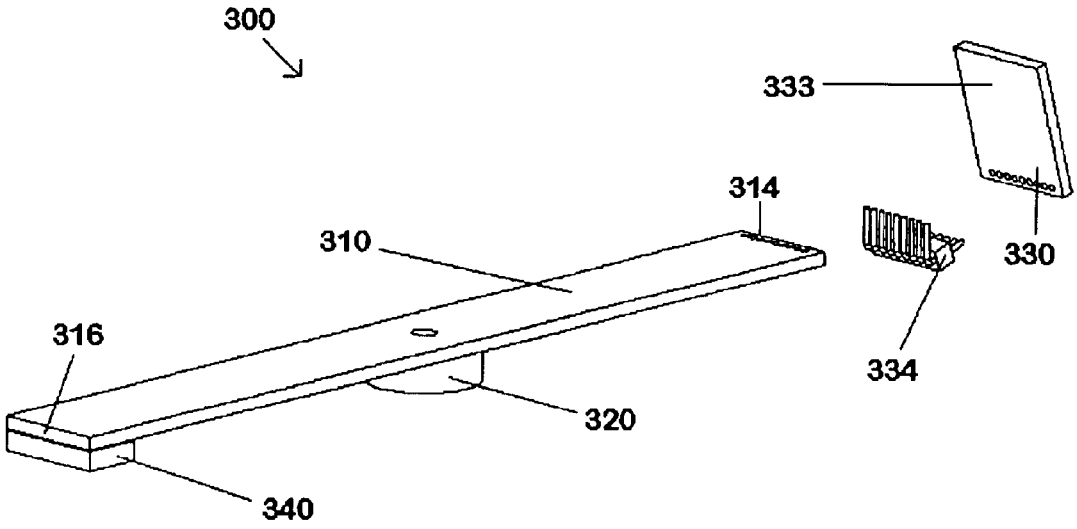

FIGS. 3A–C illustrate one embodiment of the display assembly 300, which has a display assembly PCB 310, an inductive coupler 320, a light array 330 and a counterweight 340. The display assembly components are mounted on the PCB 310, which has a generally planar and elongated shape with a first side 311, an opposite second side 312, a first end 314 and an opposite second end 316. The PCB 310 has a center hole 318 placed at the rotational center of the display assembly 300.

As shown in FIGS. 3A–C, the inductive coupler 320 has a centered cylindrical cavity 322 and is mounted on the second side 312 of the display assembly PCB 310 such that the cavity 322 is aligned with the PCB center hole 318. In one embodiment, the control assembly inductive coupler 220 (FIGS. 2A–B) and the display assembly inductive coupler 320 are each constructed from a standard 14×8 pot core wound with 35 turns of 31-gauge magnet wire.

Also shown in FIGS. 3A–C, the light array 330 is mounted proximate the first end 314. The light array 330 is comprised of 8 elements 332 which are surface-mount LEDs with associated current-limiting resistors mounted on a light array PCB 333. A 9-pin 75-degree connector 334 connects the display assembly PCB 310 and the light array PCB 333. The counterweight 340 is mounted on the second side 312 proximate the second end 316 so as to balance the display assembly 300 at the center hole 318.

Although the control assembly 200 (FIG. 2A) and the display assembly 300 (FIG. 3A) have been described as implemented with PCBs, one of ordinary skill in the art will recognize that these assemblies may be implemented with other circuit technologies, such as flexcircuits or hybrid circuits, and other support materials of various shapes and sizes within the scope of the present invention. Further, the light array 330 (FIG. 3A) may comprise any number of elements and/or columns, and the elements may utilize various light emitting or light transmitting technologies.

FIG. 4 illustrates a shaft mate 400, which has a circular disk 402 with a mate surface 442, a mate end 446 distal the mate surface 442, and a mate notched joint 404 extending normally from the mate surface 442 between the circular disk 402 and the mate end 446. The mate notched joint 404 has a generally cylindrical portion proximate the mate surface 442 and a generally semi-cylindrical portion having a flat mate face 444 proximate the mate end 446. The shaft mate 400 is mounted to the display assembly 300 (FIGS. 3A–C) with the disk 402 concentric with the PCB center hole 318 (FIG. 3A), the mate surface 442 bonded to the PCB first side 311 (FIG. 3A), and the mate notched joint 404 extending through the PCB center hole 318 (FIG. 3A) and into the inductive coupler cylindrical cavity 322 (FIG. 3B).

FIG. 5 illustrates the shaft 500, which has a circular base 502, a cylindrical spindle 504, a shaft notched joint 506 and a shaft end 516. The shaft notched joint 506 has a generally cylindrical portion attached to the spindle 504 and a generally semi-cylindrical portion having a flat shaft face 552 proximate the shaft end 516. A magnet 554 is mounted to the base 502. The shaft 500 and shaft mate 400 (FIG. 4) are attached with the shaft face 552 bonded to the mate face 444 (FIG. 4). The diameter of the shaft notched joint 506 is such that it passes freely through the controller assembly inductive coupler 220 (FIGS. 2A–B). The shaft height is such that the controller assembly inductive coupler 220 (FIGS. 2A–B) and the display assembly inductive coupler 320 (FIGS. 3A–C) are maintained at a fixed distance apart, which is less than 5 mm in one embodiment. The magnet 554 is located on the base 502 such that when the display 330 (FIGS. 3A–C) is 60 degrees from the front, it passes under the Hall-effect sensor 280 (FIG. 2B), where the front is the location of the push button 240 (FIG. 2A).

There is an important relationship among the trigger position, the rotational speed of the display assembly and the size of the apparent viewable display area. A trigger is sensed when the magnet 554 passes under the Hall-effect sensor 280 (FIG. 2B). The position of the light array 330 (FIG. 3A) at this point is about 60 degrees to the left of center as one views the front of the display where the button 240 (FIG. 2A) is located. The display assembly 300 (FIGS. 3A–C) sweeps in a counter-clockwise direction when viewed from above. So after passing the trigger position, the light array elements 332 (FIG. 3A) sweep from left to right when the display is viewed from the front.

A delay variable is utilized in the transmit trigger data block 1170 (FIG. 11) so that a virtual trigger position is realized. This is useful for adjusting the center of the apparent display data viewed from the front of the display. As the light array elements 332 (FIG. 3A) sweep an arc past the trigger position, the elements 332 (FIG. 3A) are modulated. Assuming all pixels on the display are on, all elements 332 (FIG. 3A) are turned on for 80 $\mu$s, then off for 200 $\mu$s and so on until 60 cycles are completed. Because there is a column of 8 light array elements 332 (FIG. 3A), this creates an apparent 8 high by 60 wide pixel display. When the elements 332 (FIG. 3A) are modulated starting at the same trigger position on each rotation, the pixels appear fixed in space around the cylindrical sweep of the display assembly 300 (FIGS. 3A–C). This phenomenon is known as "persistence of vision".

At a rotational speed of 800 rpm (about 13 rotations a second), the total time for 1 revolution is 75 ms. For a 60-column display where each column takes 280 $\mu$s to display, this equates to 16.8 ms for the total display time. So at 800 rpm, the viewable display area is about 80 degrees. In order to center the viewable area on the front of the display, the trigger position should be 40 degrees to the left of center. Since the magnet 554 (FIG. 5) is aligned to the display assembly 300 (FIGS. 3A–C) such that the trigger position is 60 degrees to the left of center, a delay of 20 degrees must be added between the actual trigger position and the "virtual" trigger position. Note that if the motor 160 (FIGS. 1A–B) were controlled at a greater speed, the apparent size of the display would widen. For example, if the motor 160 (FIGS. 1A–B) were spinning at 1000 rpm, the viewable display area would grow to about 100 degrees, as compared with 80 degrees at 800 rpm.

Electrical

FIGS. 6–7 illustrate an electrical hardware configuration for a rotating display system 100 (FIG. 1A). FIG. 6 illustrates control electronics 600 residing on the control assembly 200 (FIGS. 2A–B). FIG. 7 illustrates display electronics 700 residing on the display assembly 300 (FIGS. 3A–B). As shown in FIG. 6, the control electronics 600 has a control processor 610, a control memory 620, a real time clock 630, a power regulator 640, an oscillator 650, an external interface 660, a motor power switch 670 and coupling switches 680. The control electronics 600 also interconnect with the Hall-effect sensor 280 and the inductive coupler 220, described with respect to FIGS. 2A–B, above.

As shown in FIG. 6, the control electronics 600 have a DC voltage input 642 received through a power jack 260 (FIG. 2B). The DC voltage 642 is applied to a power regulator 640, which in one embodiment is a standard +5V voltage regulator having input and output filter capacitors. The power regulator 640 provides power to the processor 610 and other logic-level circuitry. The DC voltage 642 is also applied to the oscillator 650, the motor power switch 670, and the coupling switches 680 through the inductive coupler 220. The motor power switch 670 and the coupling switches 680 utilize field effect transistors (FETs) to switch the DC voltage 642. A processor output 612 controls the motor power switch 670 so as to couple the DC voltage 642 to the motor 160 (FIGS. 1A–B). An oscillator output 652 controls a first switch 810 (FIG. 8) of the inductive coupling switches 680. Another processor output 614 controls a second switch 820 (FIG. 8) of the inductive coupling switches 680. The inductive coupling switches 680 transfer DC power to the inductive coupler 220 (FIGS. 2A–B), as described with respect to FIG. 8, below.

Also shown in FIG. 6, an external interface output 664 is input to the processor 610 and to memory 620 so as to allow an external device to communicate with the processor 610 and to program memory 620. The Hall-effect sensor 280 has an output 616 to the processor 610 so as to provide a virtual trigger position, as described with respect to FIG. 5, above. The memory 620 has a non-volatile portion containing control software that functions as described with respect to FIG. 11, below. The real-time clock 630 is used to provide the time, day of week and date for display.

As shown in FIG. 7, the display electronics 700 has a display processor 710, a display memory 720, a power block 730 and a data block 740. The power block 730 and data block 740 receive power and data from the control electronics 600 (FIG. 6) via the inductive coupler 320, as described with respect to FIG. 8, below. The power block output 734 supplies power to the processor 710, memory 720 and other logic-level circuitry. The data block output 744 provides a data input to the processor 710. A processor output 712 drives the light array 330. The memory 720 has a non-volatile portion containing display software that functions as described with respect to FIG. 12, below.

Power Distribution

FIG. 8 illustrates the one way power and data transfer mechanism between portions of the control electronics 600 and portions of the display electronics 700. The switches 680 include a first switch 810 and a second switch 820 connected in series between the inductive coupler 220 and ground. The first switch 810 is actuated by the oscillator output 652. The second switch 820 is actuated by the processor output 614. Applying power to the display electronics 600 is realized by closing the second switch 820. This allows the oscillator output 652 to modulate the first switch 810, producing a square wave through the inductive coupler 220 based on the voltage of the DC power source 642. The control assembly inductive coupler 220 couples the square wave to the display assembly inductive coupler 320. The effect is to produce a similar square wave across the display assembly inductive coupler 320, with losses due to the gap between the two couplings 220, 320.

As shown in FIG. 8, the display assembly inductive coupler 320 feeds a square wave output 732 into the power block 730 and data block 740. The power block 730 has a half-wave rectifier 830, a low pass filter 840 and a voltage regulator 850. The half-wave rectifier 830 removes portions of the square-wave output 732 to generate a rectified output 832. The filter 840 smoothes the rectified output 832 to generate a filtered output 842. The regulator 850 regulates the filtered output 842 to provide the display power 734 for the display electronics 700 (FIG. 7), as described with respect to FIG. 7, above. In one embodiment, the oscillator output 652 has a 1 MHz frequency, i.e. a 1 $\mu$sec period T, and the power output 734 is +5V DC.

Communications

As shown in FIG. 8, the display assembly inductive coupler 320 also feeds the square wave output 732 into the data block 740 through a diode (not shown). The data block 740 has a low pass filter 860 and a data sampler 870. When a continuous square wave is applied to the low pass filter 860, the filter output 744 is a continuous logic "high." A data bit is transferred through the coupling 220, 320 when the control processor output 614 interrupts the square wave momentarily by opening the second switch 820. As the square wave ceases, the filter output 744 decays to a logic "low."

The data sampler 870 is realized by the display processor 710 (FIG. 7) and associated display assembly software 1200 (FIG. 12), which samples the filter output 744. As the output 744 transitions from a logic "high" to a logic "low," the display assembly software 1200 (FIG. 12) measures the time the signal stays "low." If the time is greater than 15 oscillator cycles, i.e. 15T, the transmitted data bit is determined to be "0." If the time is less than 15 oscillator cycles, 15T, the transmitted data bit is determined to be "1." Accordingly, the second switch 820 is opened for a time of 20T for a "0" and opened for a time of 10T for a "1." Eight bits are detected in this way per transmission from the control assembly 600.

In this manner, a data path is created from the control assembly 600 to the display assembly 700, across the inductive coupling 220, 320. Information is advantageously transferred over this data path via the control software 1100 (FIG. 11), described below, to the display assembly software 1200 (FIG. 12), also described below. TABLE 1 summarizes the control input 614 for the second switch 820 on the control assembly 600 and the resulting power and data transfer to the display assembly 700. Note that the oscillator interruptions required for sending data are short enough in duration and spaced far enough apart so as not to effect the power supply of the display circuitry.

TABLE 1

| CONTROL INPUT | POWER/DATA STATE |
|---|---|
| OPEN | DISPLAY ASSEMBLY OFF |
| CLOSED | DISPLAY ASSEMBLY ON |
| OPEN 20T | DATA "0" |
| OPEN 10T | DATA "1" |

Software Configuration

Figure 9:
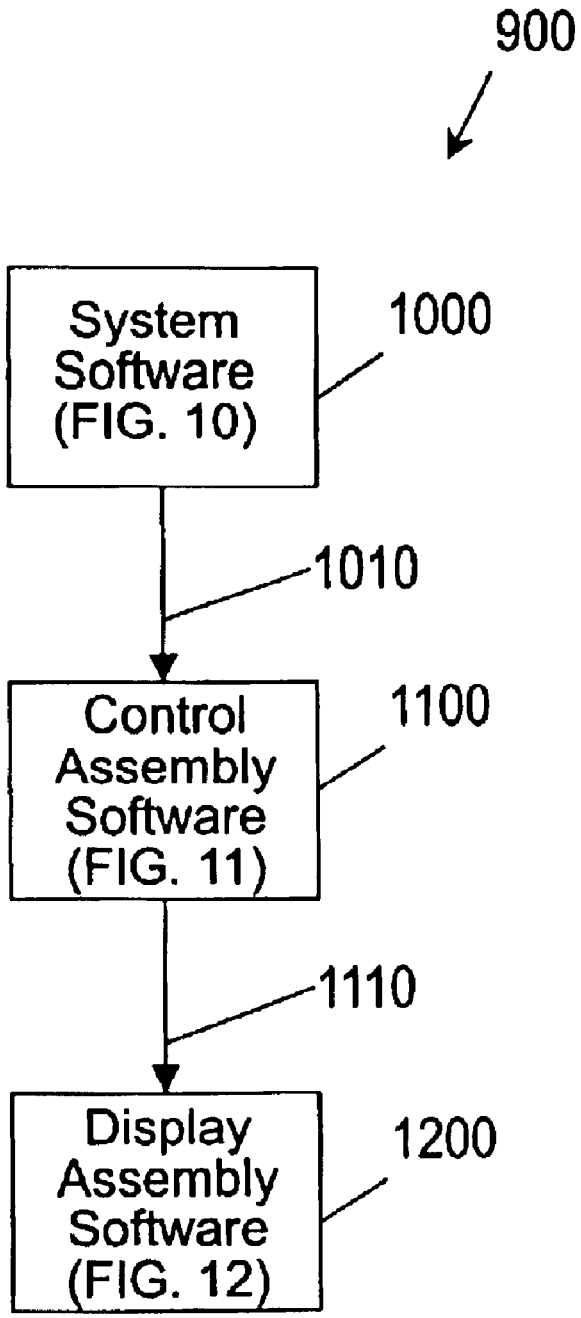
FIG. 9 is a top-level software flow diagram of a rotating display system.

FIG. 9 illustrates a software configuration 900 for a rotating display system 100 (FIG. 1A), including system software 1000, control assembly software 1100 and display assembly software 1200. The system software 1000 dictates the most abstract or high level operational aspects of the display system 100 (FIG. 1A) via instructions 1010 communicated to the control assembly software 1100. Advantageously, the system software 1000 incorporates a display application language rather than using a general software language. This makes it easier for individual users of the display system 100 (FIG. 1A) or third-party suppliers to write system software programs, such as with the help of a PC-based development kit, to customize display operation. For example, the display system 100 (FIG. 1A) may be programmed to provide custom messages for advertising, sales slogans, birthdays or anniversaries. An example of system software 1000 is described in further detail with respect to FIG. 10, below. The display application language is described and illustrated by a simple example in the "Display Operation" section, below. The display application language set is listed and described in Appendix A.

As shown in FIG. 9, an important function of the control assembly software 1100 is to interpret the system software instructions 1010 and data residing in nonvolatile memory and to carry out the operations specified. The control assembly software 1100 also transmits commands, trigger information and display data 1110 to the display assembly software 1200. Further, the control assembly software 1110 senses motor position and provides control of the motor 160 (FIG. 1A); sets, calculates and keeps track of time, including date and day of week; and services the push button switch 240 (FIG. 2A). The control assembly software 1100 is described in further detail with respect to FIG. 11, below.

Also shown in FIG. 9, the display assembly software 1200 receives and decodes the commands, trigger information and display data 1110 from the control assembly software 1100. Utilizing this information, the display assembly software 1200 transmits display data to the light array 330 (FIG. 3A). In doing so, the display assembly software 1200 translates ASCII character data to column data and controls display effects such as horizontal and vertical scrolling. The display assembly software 1200 is described in further detail with respect to FIG. 12, below.

The system software 1000, control assembly software 1100 and display assembly software 1200 are each resident within the display system 100 (FIG. 1A) when the display system 100 (FIG. 1A) is operating in a stand-alone manner. When the display system 100 (FIG. 1A) is operating as a remote slave, such as for a stock ticker getting information from a network or computer, the system software 1000 can be accessed externally via a serial cable interface (not shown) and does not need to be resident.

System Software

Figure 10:
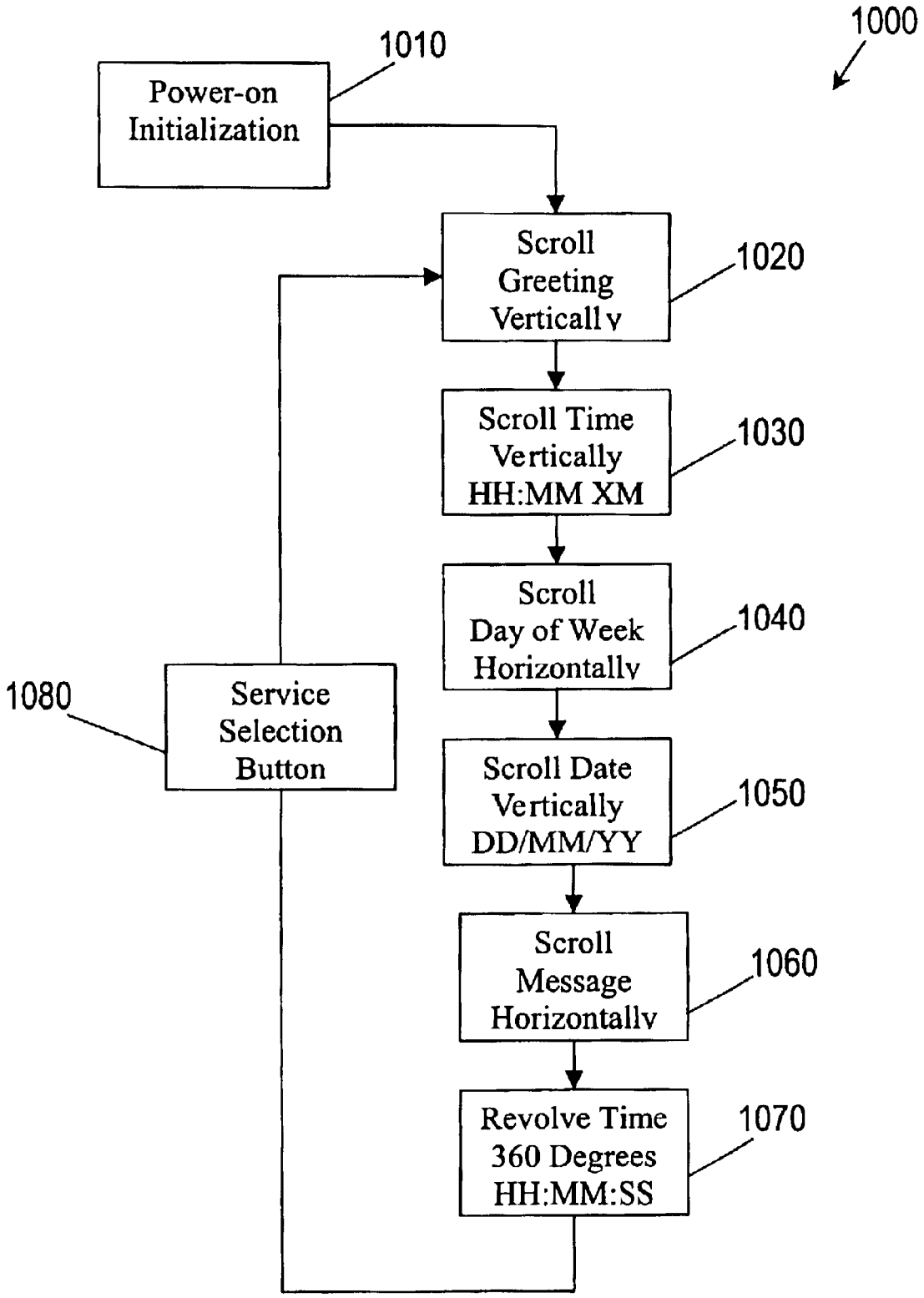
FIG. 10 is a detailed flow diagram of a system software embodiment.

FIG. 10 illustrates a particular embodiment of the system software 1000, which comprises both instructions and data that reside in nonvolatile control assembly memory 620 (FIG. 6), as described above. After power on initialization 1010, all other display instruction sequences 1020–1080 are executed in a continuous loop. In a scroll greeting vertically sequence 1020, a custom greeting (1 of 8) is loaded and scrolled vertically down into the display, held briefly and scrolled down off the display. In a similar manner, time is displayed in HH: MM AM/PM format in a scroll time vertically sequence 1030. Next, a scroll day of week horizontally sequence 1040 is executed. In a scroll date vertically sequence 1050, the date is then vertically scrolled into the display DD/MM/YY format. A scroll message horizontally sequence 1060 loads and scrolls a custom message (1 of 32). Finally, a revolve time sequence 1070 produces a slowly rotating 360 degree time display in HH: MM: SS format. The time rotates for approximately 2 minutes before a service selection button command 1080 is executed and the entire process repeats. The greeting sequence 1020 cycles through a different custom greeting each time it is executed. In a similar manner, the message sequence 1060 cycles through a different custom message each time it is executed. Appendix C is computer program listing appendix (on CD-R) corresponding to FIG. 10, which is written in the display application language described above.

Control Assembly Software

Figure 11:
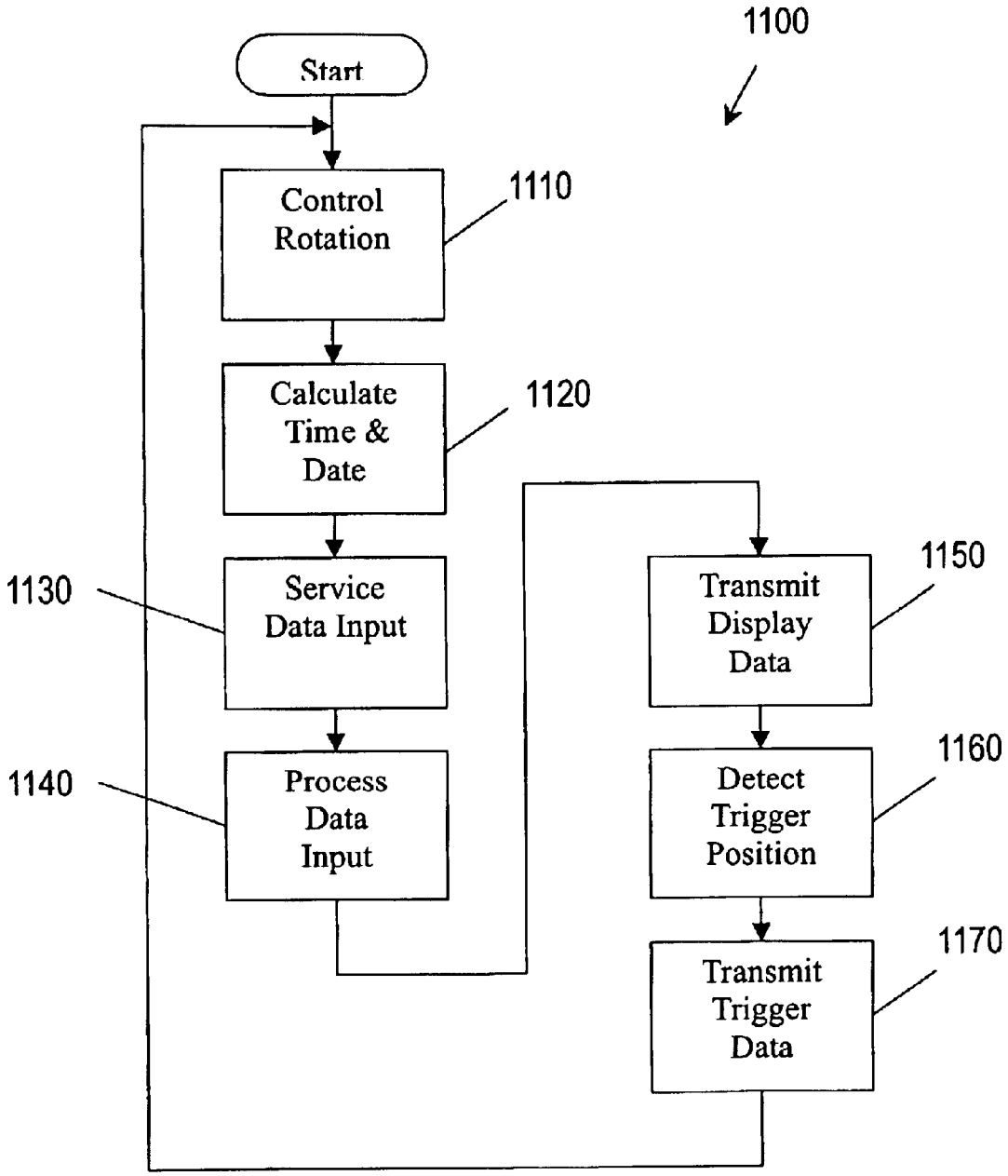
FIG. 11 is a detailed flow diagram of control assembly software.

FIG. 11 illustrates the control assembly software 1100, which has instructions and data that also reside in nonvolatile control assembly memory 620 (FIG. 6). In one embodiment, the control assembly software 1100 is written in assembler, based on the particular control assembly processor 610 (FIG. 6). Each of the instruction sequences 1110–1170 are executed in a continuous loop. In a control rotation sequence 1110, the control assembly software 1100 polls the state of the Hall effect sensor 280 (FIG. 2B) to determine if the magnet 554 (FIG. 5) has been detected. The control assembly software 1100 determines the rotational speed of the motor 160 (FIG. 1A) by measuring the time between magnet triggers. If the speed is too slow, the software 1100 increases the power to the motor 160 (FIG. 1A). If the speed is too fast, the software 1100 decreases power to the motor 160 (FIG. 1A). If the speed is too slow after 5 seconds of operation, the display is turned off. This is a safety feature that prevents the motor or power circuitry from damage during the event that someone or something is preventing the motor from turning. If the PWRON system software instruction (Appendix A) has not been encountered, the motor 160 (FIG. 1A) remains off and control passes to the next instruction sequence 1120. A calculate time and date sequence 1120 updates the time (hours, minutes and seconds), the date (month, day and year), and the day of the week variables residing in processor memory. These values can be modified or displayed using system software instructions.

Also shown in FIG. 11, the service data input sequence 1130 interprets the system software 1000 (FIG. 10). All aspects of executing the system software 1000 (FIG. 10) are handled by this instruction sequence 1130. These aspects include keeping track of the program counter, i.e. where the current instruction is located in system software memory, subroutine call and return addresses, and importantly, executing the tasks specified by each system software instruction (Appendix A). The service data input sequence 1130 also services the push-button switch 240 (FIG. 2A) and redirects program flow if the button is pressed.

Figure 12:
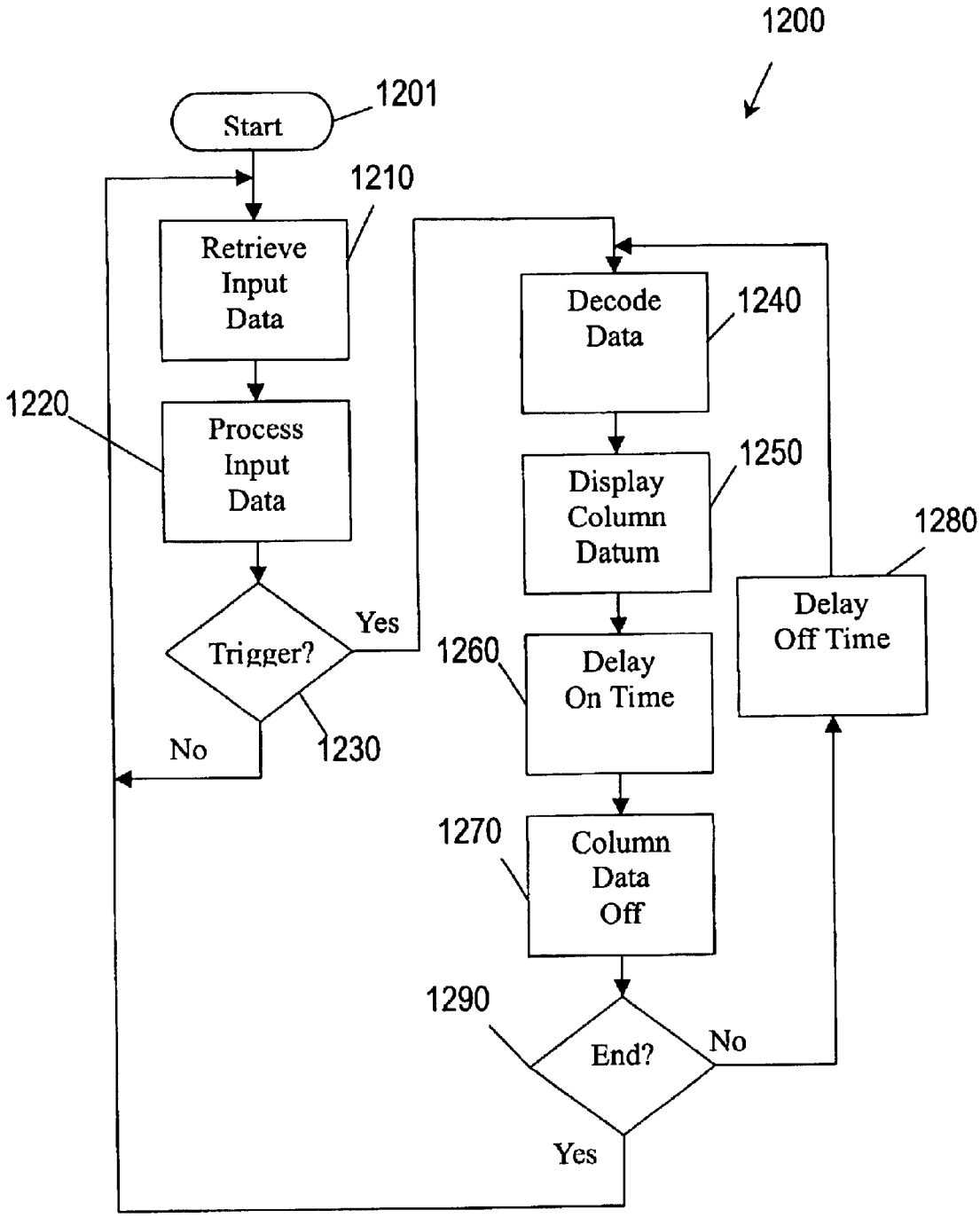
FIG. 12 is a detailed flow diagram of display assembly software.

Further shown in FIG. 11, the process data input sequence 1140 provides the interpretation of data and execution of instructions retrieved from the system software 1000 (FIG. 10). Depending on the system software display instruction, the control assembly software 1100 may take many instruction cycles to actually complete the transfer of data to the display assembly software 1200 (FIG. 12). Many of the instructions in this sequence relate to the parsing of display information so that the display assembly software 1200 (FIG. 12) can receive this information and act on it in an efficient manner. Besides handling "read only" or constant static display characters from the system software 1000 (FIG. 10), the control assembly software 1100 allows the interpretation and display of "live" variables such as time and date which dynamically change. As a result, the control assembly software 1100 allows the system software 1000 (FIG. 10) access to RAM located in control assembly processor 610 (FIG. 6) memory. The process data input sequence 1140 provides and maintains this mechanism. Further, the process data input sequence 1140 provides the basis for horizontal and vertical scrolling effects. When a scroll mode is specified by the system software 1000 (FIG. 10), the control assembly software 1100 is responsible for collecting the data to scroll, setting up the display assembly processor 710 (FIG. 7) to perform the scrolling and sending the data to scroll at the correct time.

Also shown in FIG. 11, the transmit display data sequence 1150 takes a general byte of data and transmits it over the inductive coupling 220 (FIG. 6), 320 (FIG. 7). The transmit display data sequence 1150 controls switch 2 820 (FIG. 8) in the manner described above. If switch 2 820 (FIG. 8) is open for a period of 20 oscillator periods, a data "0" is generated. If switch 2 820 (FIG. 8) is open for a period of 10 oscillator periods, a data "1" is generated. The transmit display data sequence 1150 effects the transmission of one data byte (eight bits) per sequence execution.

Further shown in FIG. 11, the detect trigger position sequence 1160 simply waits for the Hall effect sensor 280 (FIG. 2B) to trigger, i.e. when the magnet 554 (FIG. 5) passes under it. The magnet 554 (FIG. 5) is placed on the motor shaft at an angle relative to the display assembly. This magnet placement along with a programmable delay in the detect trigger position sequence 1160 allows positioning of the effective display zone on the front portion of the display, as described at the end of the "Hardware Configuration—Mechanical" section, above, and further with respect to the "Display Operation" section, below. The transmit trigger data sequence 1170 transmits a trigger code over the inductive coupling 220 (FIG. 6), 320 (FIG. 7) in the manner of the transmit display data sequence 1150, described above.

Display Assembly Software

FIG. 12 illustrates the display assembly software 1200, which has instructions and data that reside in display assembly nonvolatile memory 720 (FIG. 7). In one embodiment, the display assembly software 1200 is written in assembler, based on the particular display assembly processor 710 (FIG. 7). The display assembly software 1200 starts executing 1201 when the control assembly software 1100 (FIG. 11) powers-up the display assembly 700 (FIG. 7). A retrieve input data sequence 1210 waits for commands or data from the control assembly software 1100 (FIG. 11) coming over the inductive coupling 220 (FIG. 6), 320 (FIG. 7). No display function is performed until the retrieve input data sequence 1210 receives a command or data. Appendix B lists commands transmitted from the control assembly software 1100 (FIG. 11) to the display assembly software 1200.

As shown in FIG. 12, a process input data sequence interprets commands and data from the control assembly software 1100 (FIG. 11) and performs the appropriate function. Most of these functions simply set up data structures that are referenced when a Trigger command (Appendix B) is received. The Trigger command starts the modulation of the light array 330 (FIG. 1A). If there is no Trigger command to service, a "Trigger?" decision sequence 1230 causes the display assembly software 1200 to loop through retrieving input data 1210 and processing input data 1220. When the "Trigger?" decision sequence 1230 detects a Trigger, the display assembly software 1200 proceeds to the sequences 1240–1280 associated with the actual displaying of column information.

Also shown in FIG. 12, a decode data sequence 1240 performs several functions depending on an operating mode. The display assembly software 1200 contains tables of all standard printable ASCII characters and the columns that make up this data. If the mode is such that character text is being displayed, the decode data sequence 1240 performs ASCII to column conversions. The decode data sequence 1240 also keeps track of the sequence of column data. Further, the decode data sequence 1240 handles other display aspects such as horizontal scrolling, vertical scrolling and bit mapped graphics.

Further, shown in FIG. 12, once the column data has been determined, a display column datum sequence 1250 causes selected data to actually appear on the light array 330 (FIG. 1A). A delay on time sequence 1260 keeps the light array 330 (FIG. 1A) on for a delay period of 80 $\mu$s. Then, a column data off sequence 1270 turns-off the light array 330 (FIG. 1A). A delay off time sequence 1280 keeps the light array 330 (FIG. 1A) off for a period of 200 $\mu$s. Once all the columns that comprise the full viewable display have been shown in sequence, a "End?" decision sequence 1290 returns the display assembly software 1200 to normal pre-trigger data and instruction processing.

Display Operation

A detailed operational description of the rotating display system 100 (FIG. 1A) is given here by means of the simple system software program example provided in TABLE 2.

TABLE 2

```
//*****************************************************
Main:
        PWRON                   // Turn motor/display on
        ImdDN "Greetings!"      // Display "Greetings!"
        DLY 100                 // Wait 100 instruction cycles
        SLEEP Main              // Turn display off for a sleep period,
```

TABLE 2-continued

```
                    // then repeat
//*************************************************************
```

The program is written in a display application language described by example in this section and in further detail in Appendix A and the Display Application Language section, below. These instructions are executed sequentially. Comments are delineated by "//" and explain the operation of the program.

Power Applied

As illustrated in FIG. 11, assume that the display system 100 (FIG. 1A) has just been plugged in, i.e. power has been applied. The control assembly software 1100 will start up and begin executing the loop of instruction sequences 1110–1170 described with respect to FIG. 11, above. Processing begins with the control rotation instruction sequence 1110. Because no instructions from the system software Table 2 have been executed yet, the control rotation sequence 1110 is exited without action. The calculate time and date sequence 1120 is executed although, because the display system 100 (FIG. 1A) has just been powered on, the correct time and date have yet to be entered. For simplicity, the ability to set or display time, date or day of week information are not included in this example. Thus, no further mention is made of the calculate time and date sequence 1120 below. Time has some relevance to the SLEEP instruction (Appendix A) in that the correct elapsed time must be measured, but it is assumed throughout this example that the calculate time and date sequence 1120 is continually keeping track of time.

PWRON

Also illustrated in FIG. 11, the next instruction sequence to be processed is service data input 1130. At this time the control assembly software 1100 fetches the first system software instruction, which, as shown in Table 2, is PWRON. The PWRON instruction is stored for use by the process data input sequence 1140, which executes the instruction, i.e. performs the functions associated with the PWRON instruction. These functions include enabling the motor 160 (FIG. 1A), enabling the control rotation sequence 1110, applying power to the display assembly 300 (FIG. 1A) and determining whether the motor 160 (FIG. 1A) is spinning correctly. If the motor 160 (FIG. 1A) is not spinning correctly, the control assembly software 1100 shuts off power to both the motor 160 (FIG. 1A) and the display assembly 300 (FIG. 1A) and suspends program execution. If the motor 160 (FIG. 1A) is spinning correctly, the traverse through the control assembly software loop 1110–1170 continues.

The transmit display data sequence 1150 does not send display data at this time because the PWRON instruction does not require it. The detect trigger position sequence 1150 detects a trigger point as the magnet 554 (FIG. 5) passes under the Hall-effect sensor 280 (FIG. 2B), but no trigger command is sent to the display assembly software 1200 (FIG. 12), again because the PWRON instruction does not require it. This completes one system software instruction cycle, and another cycle begins at the beginning of the control assembly software loop 1110–1170.

On this next pass of the control assembly software loop 1110–1170, because the motor 160 (FIG. 1A) has been enabled, the control rotation instruction sequence 1110 operates to ensure the speed of the motor is within tolerance. In one embodiment, the motor 160 (FIG. 1A) speed is about 900 rpm+/−100 rpm. In subsequent passes, the control rotation sequence 1110 continues the same function of controlling the motor motor 160 (FIG. 1A). Thus, no further mention is made of the control rotation sequence 1110 below.

ImdDN "Greetings"

Further illustrated in FIG. 11, another system software instruction is fetched during the service data input sequence 1130. On this pass, the instruction is ImdDN with the parameter "Greetings!" ImdDN stands for "Immediate addressing, Display Normal mode." All of the Imd class system software instructions use immediate addressing, which means that the character data associated with the instructions are located in memory immediately following the instruction itself. All of the DN type system software instructions are "normal display" functions, meaning there are no special scrolling effects associated with the instruction's execution.

ImdDN causes several things to happen. First of all, the process data input block saves the instruction so that subsequent system software memory accesses are interpreted as character data. Thus, no more instructions will be interpreted until the character string parameter of the ImdDN instruction has been read and processed. Until all of the data, in this case the characters 'G', 'r', 'e', 'e', 't', 'i', 'n', 'g', 's', '!,' have been read, the control assembly software 1100 will execute its loop of instruction sequences 1110–1170 only gathering data and processing it. Before the first data byte is processed, the control assembly software 1100 sends a mode byte to the display assembly software 1200 (FIG. 12) via the inductive coupling 220 (FIG. 6), 320 (FIG. 7) between the control assembly 200 (FIG. 2A) and the display assembly 300 (FIG. 3A).

The transmission of the mode byte to the display assembly software 1200 (FIG. 12) allows it to handle subsequent data in an appropriate manner. In this case, the mode is normal with no scroll effects. Each byte of data, such as the first 'G' in "Greeting," is sent in sequence via the inductive coupling 220 (FIG. 6), 320 (FIG. 7) to the display assembly software 1200 (FIG. 12), as described above. This occurs at a rate of one character per control assembly software cycle, i.e. one pass through the loop 1110–1170. When all the data has been processed, the control assembly software 1100 completes the processing of the ImdDN command by enabling trigger transmissions. From this point, a trigger command is sent to the display assembly software 1200 (FIG. 12) on each pass through the transmit trigger data sequence 1170. In this example, once the ImdDN instruction and associated parameter data have been processed, when the next trigger position is sensed, the control assembly software 1100 sends a trigger command byte to the display assembly software 1200 (FIG. 12).

As illustrated in FIG. 12, a retrieve input data sequence 1210 receives data from the control assembly software 1100 (FIG. 11), such as the 'G' in "Greeting." The process input data sequence 1220 places the data in a display buffer, such as a data RAM portion of the display assembly processor 710 (FIG. 7), as the data is received. Once a trigger command has been received from the control assembly software 1100 (FIG. 11), the process input data sequence 1220 passes the trigger command to the "Trigger?" decision sequence 1230. Then, control passes to the decode data sequence 1240, which checks the mode of the display (in this case normal, no scrolling effects), retrieves the ASCII 'G' character (the first character of Greeting!") from the data buffer, and performs a table lookup to fetch the first column data associated with the 'G' character. A display column datum sequence 1250 writes the column data to the light array 330 (FIG. 1A). A delay on time sequence 1260 allows the column data to remain displayed for 80 $\mu$s. A column data off sequence 1270 turns off the light array 330 (FIG. 1A). Because this is only the first column, the "End?" condition of a decision sequence 1290 is not satisfied. A delay off time sequence 1280 keeps the light array 330 (FIG. 1A) off for 200 $\mu$s. Next, the decode data sequence 1240 fetches the second column of the ASCII 'G' and the process repeats. Once all columns of all characters in the data buffer have been sequentially displayed, control returns to the retrieve data input sequence 1210. Each time the display assembly software 1200 receives a trigger command from the control assembly software 1100 (FIG. 11), this entire display process repeats.

DLY 100

Meanwhile, in the control assembly software 1100 (FIG. 11), the next system software instruction is ready for execution. This instruction is the DLY instruction with an accompanying parameter of "100." This instruction does nothing for 100 cycles of the control assembly software loop 1110–1170 (FIG. 11) while still allowing trigger instructions to be passed to the display assembly software 1200. The net effect is that the display will be showing the characters "Greetings!" for 7.5 seconds. That is, at 800 rpm the motor 160 (FIG. 1A) rotates once every 75 ms, and 75 ms times 100 delay cycles is 7.5 seconds.

SLEEP Main

After the DLY instruction has completed, the next system software instruction, SLEEP, is queued. The SLEEP instruction turns off the motor 160 (FIG. 1A), turns off display system power and suspends program execution a pre-defined amount of time, such as 5 minutes. Once the sleep time has elapsed, program execution resumes at the address specified in the sleep parameter, "Main." Summarizing the example, the system software (Table 2) causes the display system 100 (FIG. 1A) to operate indefinitely, displaying the message "Greetings!" for about 8 seconds, then shutting off for 5 minutes then repeating the process. One of ordinary skill in the art can extrapolate the operation of this example, although a simple one, to the operation of more complex system software implementations, such as disclosed in FIG. 10 and a corresponding computer program listing Appendix C.

Display Application Language

The system software display application language utilizes an instruction set that performs the specific tasks that a display would normally perform. Tasks such as displaying a set of characters ("Hello!") and scrolling these characters vertically or horizontally are all incorporated in this instruction set. The display application language instruction set is listed and described in Appendix A and, for some instructions, additionally below.

SETT allows the system software to set the correct day of the week, time and date by accessing a data RAM portion of the control assembly processor 610 (FIG. 6). Through the use of other instructions, variables may be written to data RAM to provide the current calendar and time information. When SETT is executed, these variables are loaded into a real time clock 630 (FIG. 6) that is then automatically serviced as long as power is applied to the rotating display system.

FLOAT is used to alter the timing of the display trigger point, as described above, such that the viewable display area can rotate 360 degrees around the cylindrical circumference of the display.

SYNC is used to transition from the FLOAT mode. It restores the trigger point to its normal center position at the "front" of the display, as described above.

NEXT is an important instruction used in conjunction with the push button switch 240 (FIG. 2A). The parameter to NEXT is a system software address. If the switch 240 (FIG. 2A) is pushed at any time during the execution of the system software, program execution will continue at the address specified by the NEXT parameter. This allows the rotating display system to provide a user-friendly interface for the prompting of user input.

The rotating display system has been disclosed in detail in connection with various embodiments of the present invention. These embodiments are disclosed by way of examples only and are not to limit the scope of the present invention, which is defined by the claims that follow. One of ordinary skill in the art will appreciate many variations and modifications within the scope of this invention.

APPENDIX A: SYSTEM SOFTWARE INSTRUCTIONS

Display Related Instructions:

ImdDN: (Immediate addressing, Display Normal), Display the set of characters immediately following this instruction, no scrolling.

ImdDV: (Immediate addressing, Display Vertical scroll), Display the set of characters immediately following this instruction, vertical scroll.

ImdDH: (Immediate addressing, Display Horizontal scroll), Display the set of characters immediately following this instruction, horizontal scroll.

DirDN: (Direct addressing, Display Normal), Display a set of characters located at the address following the instruction, no scrolling.

DirDV: (Direct addressing, Display Vertical scroll), Display a set of characters located at the address following the instruction, vertical scroll.

DirDH: (Direct addressing, Display Horizontal scroll), Display a set of characters located at the address following the instruction, horizontal scroll.

StblDN: (Short Table, Display Normal), Display a set of characters in a short table by address and index, no scrolling.

StblDV: (Short Table, Display Vertical scroll), Display a set of characters in a short table by address and index, vertical scroll.

StblDH: (Short Table, Display Horizontal scroll), Display a set of characters in a short table by address and index, horizontal scroll.

LtblDN: (Long Table, Display Normal), Display a set of characters in a long table by address and index, no scrolling.

LtblDV: (Long Table, Display Vertical scroll), Display a set of characters in a long table by address and index, vertical scroll.

LtblDH: (Long Table, Display Horizontal scroll), Display a set of characters in a long table by address and index, horizontal scroll.

General Instructions

SETT: (Set Time), Set time/date/day of week.

RTN: (Return), Return from subroutine.

PWRON: (Power On), Turn motor and power to display on.

PWROFF: (Power Off), Turn motor and power to display off.

SYNC: (Synchronize), Use absolute position for display trigger.

DLY: (Delay), Delay a number of instruction cycles.

FLOAT: (Float), Use relative position for display trigger.

JUMP: Jump to another program instruction.

CALL: Call a subroutine.

ADD: Add two data bytes.

AND: Logical And of two data bytes.

OR: Logical Or of two data bytes.

COPY: Copy a data byte from one address to another.

WRITE: Write constant data to address in controller memory.

IFZ: (If Zero), If a data byte is zero, skip next instruction.

NEXT: Store a jump address for the next button press.

SLEEP: Disable display/motor and stop executing instructions for a specified time.

POKED: (Poke Display), Poke a value at a data address in the display processor.

APPENDIX B: CONTROL ASSEMBLY TO DISPLAY ASSEMBLY COMMANDS

Trigger: Causes the Display software to process and display column data.

SysReset: (System Reset), Re-initializes all the Display software variables.

PokeVar: (Poke Variable), Stores data byte at address.

TestMsg: (Test Message), Test message displayed on Trigger command.

TestLEDs: Causes a specified LED to momentarily flash.

FillBtMp: (Fill Bit Map), Fills a bit map data area in memory.

PutBtMp: (Put Bit Map), Places a stream of data in bit map memory.

InvBitMap: (Invert Bit Map), Changes all bit map data "1"s to "0"s and "0"s to "1"s.

PutChar: (Put Character), Places data in memory and/or sets the buffer pointer.

What is claimed is:

1. A display system comprising:

a base;

an electric motor supported by said base;

a shaft extending from said motor and operable so as to rotate when power is applied to said motor;

an elongated, generally planar display assembly center mounted to said shaft so that said display assembly rotates as said shaft rotates;

a light array mounted to an end portion of said display assembly so as to sweep out a generally cylindrical path as said display assembly rotates;

an elongated, generally planar control assembly fixedly mounted to said base between said motor and said display assembly, said control assembly configured to accommodate said shaft; and an inductive coupling adapted to provide electrical communications between said control assembly and said display assembly.

2. The display system according to claim 1 further comprising:

a first switch located on said control assembly configured to transfer power from a power source to said inductive coupling; and a power block located on said display assembly configured to transfer power from said inductive coupling to said display assembly.

3. The display system according to claim 2 further comprising:

a first processor located on said control assembly and operable to generate a plurality of display commands;

a second switch located on said control assembly and in electrical communications with said first processor, said second switch configured to transfer said display commands to said inductive coupling;

a second processor located on said display assembly; and a data block located on said display assembly configured to transfer said display commands from said inductive coupling to said second processor, said second processor operable to transfer display data to said light array according to said display commands.

4. The display system according to claim 3 further comprising a sensor output responsive to a position of said display assembly relative to said control assembly, said first processor in communications with said sensor output so as to generate a trigger command to said second processor, said trigger command incorporating a variable trigger delay, said trigger command indicating the apparent position of a pixel display.

5. The display system according to claim 4 further comprising a push button switch operable in conjunction with a menu presented on said pixel display so as to set an operational mode.

6. The display system according to claim 5 further comprising a plurality of display language instructions for display specific tasks, said display language instructions interpreted by said first processor so as to generate said display commands.

7. The display system according to claim 3 wherein said inductive coupling comprises:

a first inductive coupler mounted on said display assembly concentric with said shaft; and a second inductive coupler mounted on said control assembly concentric with said shaft, said first inductive coupler and said second inductive coupler maintained at a fixed distance apart.

8. The display system according to claim 4 wherein said sensor comprises:

a Hall-effect sensor mounted on said control assembly; and a magnet mounted on a base portion of said shaft so that said magnet repeatedly passes under said Hall-effect sensor as said shaft rotates.

9. A display method comprising the steps of:

describing a pixel display with a display instruction;

interpreting said display instruction so as to create a display command;

generating a data signal responsive to said display command;

deriving a plurality of column data responsive to said data signal;

rotating a display assembly about an axis so that a light array mounted on said display assembly sweeps along an arc surface;

modulating said light array with said column data so as to create a viewable area of said pixel display across at least a portion of said arc surface;

combining a power source and said data signal into a waveform;

inductively coupling said waveform to said display assembly;

filtering display assembly power from said waveform; and decoding said data signal from said waveform, wherein said waveform is a square wave, said data signal is a plurality of bits and said combining step comprises the substeps of switching said power source so as to generate said square wave, interrupting said square wave for a first time period in response to each of said bits that is a one, and interrupting said square wave for a second time period in response to each of said bits that is a zero, and wherein said square wave has a time period of T and said first time period is about 10T and said second time period is about 20T, said decoding step comprising the substeps of:

generating a zero bit if said square wave ceases for a time period greater than 15T; and generating a one bit if said square wave ceases for a time period less than 15T.

10. A display method comprising the steps of:

describing a pixel display with a display instruction;

interpreting said display instruction so as to create a display command;

generating a data signal responsive to said display command;

deriving a plurality of column data responsive to said data signal;

rotating a display assembly about an axis so that a light array mounted on said display assembly sweeps along an arc surface;

modulating said light array with said column data so as to create a viewable area of said pixel display across at least a portion of said arc surface;

combining a power source and said data signal into a waveform;

inductively coupling said waveform to said display assembly;

filtering display assembly power from said waveform;

decoding said data signal from said waveform;

sensing a trigger position of said display assembly;

adding a variable delay to said trigger position so as to create a virtual trigger position;

initiating said modulating step in response to said virtual trigger position; and adjusting said variable delay so as to position said viewable area.

11. The display method according to claim 10 comprising the further steps of:

designating a front position for said pixel display;

calculating said viewable area from a rotational speed of said display assembly and a number of columns of said pixel display; and determining said variable delay from said viewable area and said trigger position so as to position a center of said viewable area at said front position.

* * * * *